US005857561A

United States Patent [19]

Hardman et al.

[11] Patent Number: 5,857,561

[45] Date of Patent: Jan. 12, 1999

[54] TOBACCO CONVEYOR BELT

[75] Inventors: David Hardman, Near Bury; Ian Sayers, Near Preston, both of United Kingdom

[73] Assignee: Scapa Group PLC, Blackburn, United Kingdom

[21] Appl. No.: 709,677

[22] Filed: Sep. 9, 1996

[30] Foreign Application Priority Data

Sep. 14, 1995 [GB] United Kingdom ..... 9518802

[51] Int. Cl.[6] ..... B65G 15/30

[52] U.S. Cl. ..... 198/846; 198/844.1; 198/689.1

[58] Field of Search ..... 198/844.1, 689.1, 198/846, 847, 850

[56] References Cited

U.S. PATENT DOCUMENTS

| | | | |
|---|---|---|---|
| 3,080,079 | 3/1963 | Lecrone et al. | 198/689.1 X |
| 4,860,569 | 8/1989 | Herdzina | 198/846 X |
| 5,213,203 | 5/1993 | Kinney et al. | 198/850 |
| 5,342,250 | 8/1994 | Sanders . | |
| 5,487,707 | 1/1996 | Sharf et al. | 474/253 |
| 5,605,217 | 2/1997 | Risley et al. | 198/689.1 X |

FOREIGN PATENT DOCUMENTS

| | | |
|---|---|---|
| 4362980A | of 0000 | Japan . |
| 5058421A | of 0000 | Japan . |
| 60144254A | of 0000 | Japan . |
| 1 086 199 | 10/1964 | United Kingdom . |
| 1 243 008 | 8/1971 | United Kingdom . |
| 1 414 084 | 11/1975 | United Kingdom . |
| 1 555 664 | 11/1979 | United Kingdom . |
| 1 560 921 | 2/1980 | United Kingdom . |

OTHER PUBLICATIONS

British Search Report.

*Primary Examiner*—James R. Bidwell

*Attorney, Agent, or Firm*—Jacobson, Price, Holman & Stern, PLLC

[57] ABSTRACT

A tobacco conveyor belt having a regular nonwoven mesh structure. The belt may incorporate an ultra-violet sensative material.

20 Claims, 2 Drawing Sheets

TOBACCO CONVEYOR BELT

BACKGROUND OF THE INVENTION

1. Field of the Invention

The present invention relates to tobacco conveyor belts for use in the manufacture of cigarettes and preferably, but not exclusively to so-called suction tapes.

2. Description of Related Art

During the manufacture of cigarettes a measured quantity of tobacco is taken up from a first tobacco conveyor belt by a second tobacco conveyor belt, i.e. the so-called suction tape, which generally has a width in the range from 0.5 to 1.5 cm. A diagrammatic illustration of a machine for making cigarettes is shown in FIG. 1. Each disposed line of tobacco is urged from the first tobacco conveyor belt 1 against the underside of a suction tape 2. The suction tape 2 runs within a groove in a suction box 3, the base of the groove being defined by a recessed ladder-like structure defined by two or more longitudinal rods linked together at spaced intervals by bars. The suction box 3 ensures that the suction tape 2 is urged upwardly against the recess ladder-like structure so that the tobacco is urged against the underside of the suction tape 2. The tobacco rod thus formed is removed from the suction tape 2 by means of inclined scraper blades 5, whereupon it falls onto enveloping cigarette paper supplied on a further conveyor belt, i.e. the so-called garniture belt 4.

Conventional suction tapes are woven endless, or alternatively are flat woven and then joined by ultrasonic means. Typically a single continuous weft (cross machine direction) yarn is provided thus presenting a large number of selvedges at the fabric edges. The selvedges are highly susceptible to abrasion accelerating fabric failure. The bunched nature of the warp (machine direction) yarns results in a somewhat non-uniform belt permeability and therefore a less even distribution of tobacco. Furthermore the narrowness of the belt requires complicated and expensive weaving machinery.

SUMMARY OF THE INVENTION

It is an object of the present invention to provide a tobacco conveyor belt with improved resistance to wear and abrasion, so as to provide a belt with an increased working life.

According to a first aspect of the present invention there is provided a tobacco conveyor belt having a regular, non-woven mesh structure.

This structure exhibits superior resistance to abrasion and wear when compared to woven structures as no wear-susceptible selvedges are provided along the longitudinal edges of the fabric. Instead a continuous edge of solid mesh polymer matrix material is present. The regular mesh structure further provides a uniform permeability.

The conveyor belt has particular, but not exclusive use, as a suction tape. The belts of the invention may be made endless so as to avoid the need for complicated joining methods, for example by ultrasonic welding. Suitable methods for making endless structures are described hereinafter. The absence of a joint eradicates a major weak point in the structure. The tensile strength may be enhanced by the incorporation of longitudinally extending reinforcing yarns, ideally of high modulus, low elongation material wholly in the lands of the mesh running in the intended machine direction of the belt. A woven fabric possesses a high degree of crimp. Hence a large number of positions of localised wear are present in known woven structures. However, in the mesh structure of the present invention the reinforcing yarns are embedded within a polymer matrix as described above. Therefore there can be no localised wear of the reinforcing yarns. Examples of suitable materials for the reinforcing yarns include aramid, liquid crystal polymer Nomex (trade mark). Polyamide (eg. PA 6.6), polyester (eg. PET) and copolyester (eg. PCTA). The reinforcing yarns may be monofilaments, multifilaments, twisted yarns, cabled yarns or braided yarns. Combinations of relatively cheap materials such as PET or PA 6.6 may be combined with more expensive high performance materials such as aramids (eg. Kevlar) or liquid crystal polymers. It is the reinforcing yarns that provide the belt with the tensile strength and load elongation properties. The reinforcing yarns are generally 280–900 denier. Preferably each running direction land contains a reinforcing yarn for strength purposes, although more than one yarn may be Contained within each running direction land. The matrix material is generally a thermoplastic polymer which preferably does not form any toxic substances if pyrolyzed as a consequence of abraded polymer particles entering into the tobacco and then being subjected to thermal degradation as the cigarette is smoked. Preferred matrix materials include polyamide, polyester, polyolefins (eg polyethylene or polypropylene), silicones and oxide polymers (eg polyphenylene oxide). Additional examples of preferred matrix material are those known as thermoplastic elastomers (eg. Hytrel, a Du Pont trade name) and nylon 6 (eg Grilon 4100, a trade name of EMS Grilon).

No expensive and complicated weaving or knitting machinery is required for manufacture.

The mesh belt is completely nonwoven and is formed by casting a molten polymer onto a pinned plate, such that the melt fills the interstices between the pins to form a regular mesh structure. The belts of the invention may be made endless by spirally melting a yarn onto an optionally rotatable, pinned drum. Alternatively the two ends of a flat moulded structure are brought into butting or overlap relationship on a pinned plate. The two ends of the belt are then softened and fused together. Both methods avoid the problem of fabric "blinding" in which molten polymer blinds the passages through the fabric during the joining stage.

The permeability of the mesh structure may be accurately controlled by changing the pin plate pattern. The meat may be in the form of a flow of extruded polymer, optionally in combination with one or more reinforcing yarns. Alternatively core-sheath yarns may be laid onto the plate and then heated to cause the sheath polymer material to melt and fill the interstices, whilst the core material which has a significantly higher melting point remains intact, forming a series of longitudinal reinforcing yarns. The polymer preferably comprises at least one thermoplastic material such as polyamide or polyester. The thermoplastic nature of the fabric enables it to be recycled after use. Alternatively co-mingled yarns (also known as intimately spun yarns) may be used in place of core-sheath yarns. Here the low melting point polymer component would act as the sheath, whilst the high melting point polymer component (an organic polymer or inorganic material, such as glass, ceramic, carbon or metal) would act as the core. Examples of co-mingled yarns include the, range of HELTNA (trade mark) yarns supplied by Courtmulds.

It is noted that suction tapes do not run completely within a slot, but instead bridge it so that the edge sections of the tape are in contact with metal runners. Control of the edge sections with these runners result in wear in the edge regions. The present invention seeks to solve this problem by making the edge regions of the tape thicker in the width direction so as to provide greater edge strength, for resistance to cutting and wear by possibly corroded and/or sharp edges of the metal runners. The use of more material in the edge runners further improves abrasion resistance and results in a significant reduction in the amount of tobacco held in the edge recesses. It is noted that the use of conventional woven tapes result in a large build up of tobacco in the weave interstices of the tape at the edge regions.

The required structure may be achieved by using a pinned plate whose interstices at the edges have a greater width and/or depth (say 15–100% greater dimensions) so that when molten polymer is cast onto the plate there is a higher proportion of polymer matrix in the edge regions. Where the molten polymer is provided by means of a core-sheath yarn with a meltable sheath material it is preferred that the core yarns have a larger diameter than those in the centre of the tape, and/or the diameter of the yarn itself may be greater due to a larger sheath. If only reinforcing yarns are laid on a case molten polymer then these too are preferably of greater diameter at the edges than those in the centre regions for the same reason, namely that there is a larger volume of polymer matrix to reinforce.

The edge of the belt may not have a uniform width, whereby at least some of the cross-machine lands extend beyond the main body of the fabric in the width direction by a distance of 0.2–0.8 mm so as to improve the guiding of the belt and extend the life of the belt by allowing more wear before failure.

The centre running land may be coloured by coating or by incorporating pigment or dye into the polymer matrix material of the running direction land. The resultant, preferably red, coloured line can be used to assist the calibration of a cigarette machine by means of an infra-red sensor each time a belt is replaced.

At least one ultra-violet sensitive material, such as an optical brightener may be added to the matrix polymer melt, so that once the tobacco conveyor belt begins to wear said UV-sensitive material is immediately detected by sensors located immediately downstream of the belt apparatus, indicting that the belt is ready for replacement. Fabric wear can be detected at an early stage, preventing the accumulation of polymer material in the tobacco, which should otherwise be harmful if combusted. The ultra-violet sensitive material may be incorporated into yarns of conventional woven tobacco conveyor belts, such as suction tapes or garniture tapes. For belts containing one or more layers of uv-curable resin the required dense edge region, as referred to above, may be achieved by modifying the pattern of the mask. The thickness of the tape at the edge regions may be increased by successively building one or more additional layers of uv-curable resin in this area once again using a different mask pattern. This provides the desired large amount of polymer to yield dense (preferably non-porous) edge regions.

According to a second aspect of the present invention these is provided a tobacco conveyor belt comprising, at least in part, an ultra-violet sensitive material.

The smoothness of the faces of the tobacco conveyor belt can be selected so as to suit the end use of the belt. Generally suction tapes for medium speed cigarette taking machines handling long fibre tobacco are relatively smooth on both the suction box face and the tobacco contacting face of the tape. However, the tapes for use with normal tobacco blends have a relatively high coefficient of friction on both faces of the tape. With high speed machines handling expanded tobacco blends the suction box side of the belt is relatively smooth and the tobacco contacting side is relatively rough having a higher coefficient of friction in order for a sufficient quantity of tobacco to be picked up by the belt. This high coefficient of friction may be achieved either by providing the tobacco contacting surface of the belt with a regular or random pattern of profiles, especially regularly spaced ribs in the transverse direction, and/or by means of a wear resistant material such as silica, alumina, ceramic, Cabosil (trade mark), carborundum, metal or hard polymer particles to induce high friction. Said wear resistant particles are added into the pin plate prior to the matrix polymer melt and become embedded in the surface region of the polymer material. The friction coefficient lowering material, typically an ormocer, ultra high molecular weight UHMW) material (eg. polyethylene or polypropylene) may be provided on the suction box Blot side of the belt to reduce the heat generated as a result of the friction forces between the belt and the box as said belt travels at a speed in the order of 400–800 m/s at a vacuum of 50–150 mbar.

BRIEF DESCRIPTION OF THE DRAWINGS

In order that the present invention may be more readily understood a specific embodiment thereof will now be described by way of example only with reference to the accompanying drawings in which.

DETAILED DESCRIPTION OF THE DRAWINGS

Figure 1:
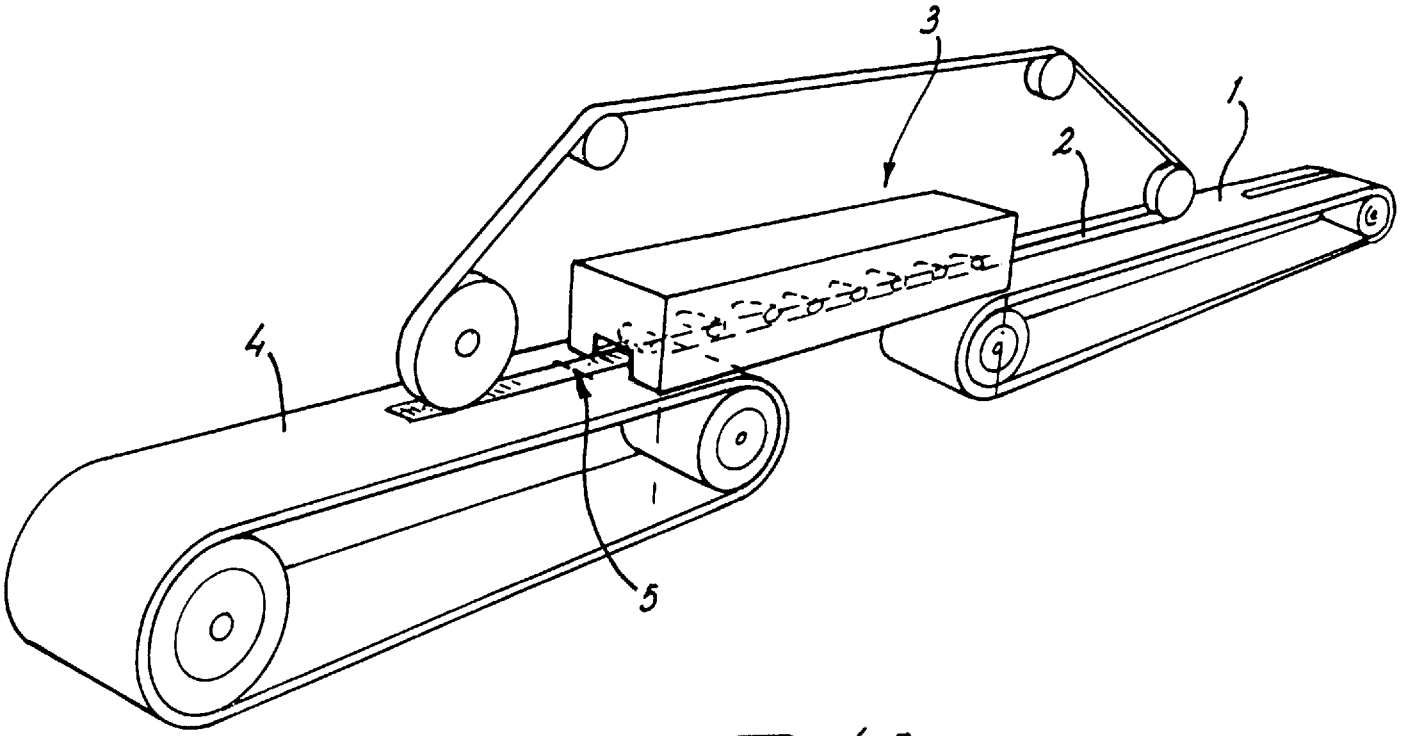
FIG. 1 (PRIOR ART)
FIG. 1 is a diagrammatic illustration of a conventional cigarette making machine.

The machine of FIG. 1 has been discussed in detail in the introductory paragraphs hereof and will not be discussed further here.

Figure 2:
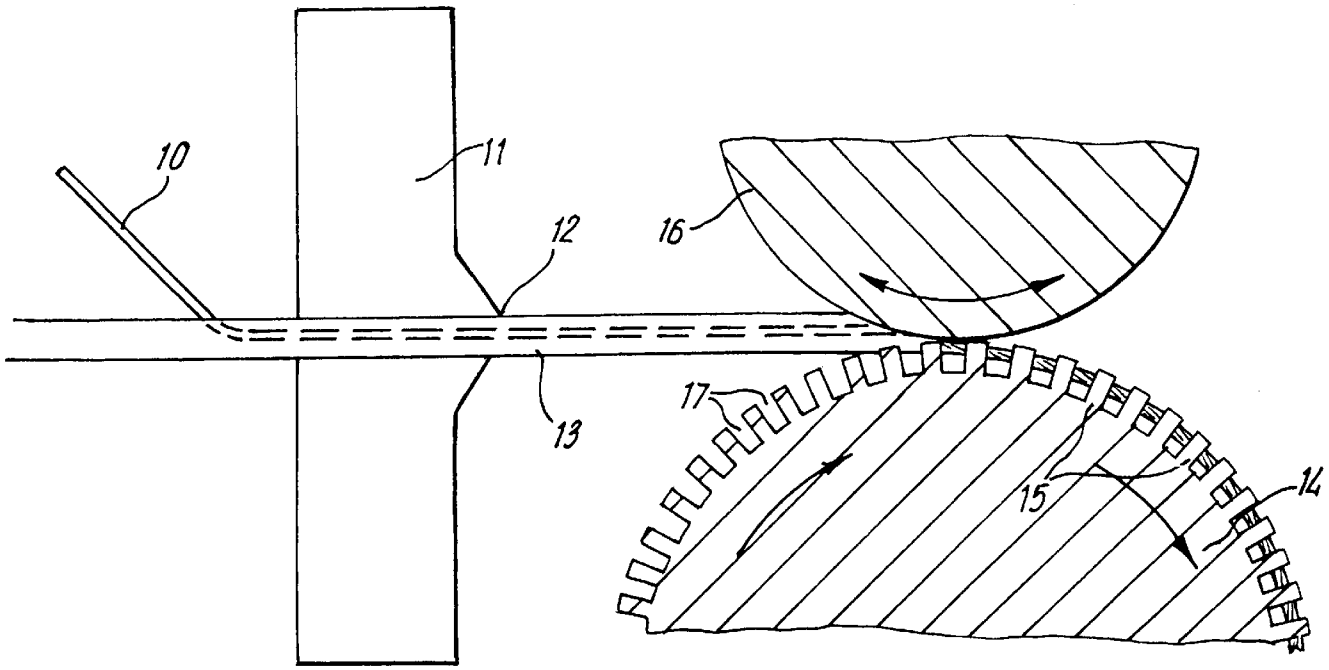
FIG. 2 a diagrammatic illustration of the apparatus is for making the belt of the present invention.

Referring to FIG. 2 a plurality of pre-tensioned yarns 10 is fed into an extruder die 11 attached to an extruder which is filled with matrix material. The extruder die outlet 12 is shaped to provide a ribbon-like tape 13 having a side-by-side array of parallel yarns encapsulated within molten plastic matrix material. While the matrix material is still in a molten state the newly formed tape 13 is fed into a section of a drive roll 14 comprising an array of pins 15. The drive roll 14 is driven by a variable speed motor at a speed to accommodate the output flow of the extruder.

Immediately subsequent to contact with the pinned section 15 the newly formed tape 13 is subjected to conditions of heat and pressure by a heat press roll 16 thereby forcing the still soft extrudate into the grooves 17 between the pins. Yarns within the tape 13 are guided into engagement with machine direction grooves between the pins, where they are surrounded and encapsulated by solidifying plastic matrix material. Plastic matrix material is likewise forced into cross-sectional grooves so as to form cross-directional interconnecting structural members. In this manner a plastics tape having a mesh structure is formed in which reinforcing yarns extend in the machine direction thereof. The reinforcing yarns extend in the running direction of the mesh.

The mesh tapes discussed above may be brought into endless form by laying the two ends of the tape together on a separate pinned plate and softening and fusing the tale ends whilst in butting or overlap relationship. This may be aided by ultra-sonic techniques.

Part of the endless suction tape produced in the manner described above is illustrated in FIG. 3.

Figure 3:
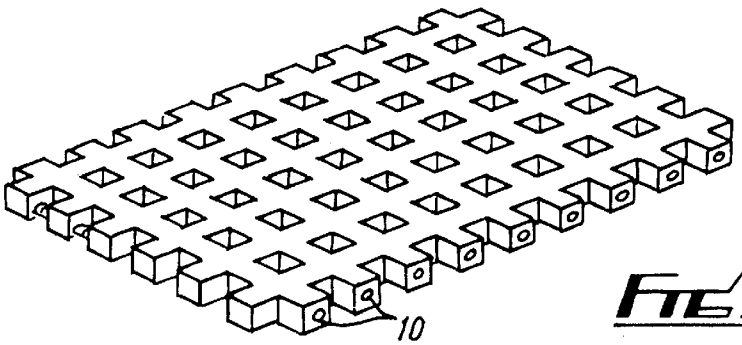
FIG. 3 shows one belt in accordance with the present inventions.

The tape of FIG. 3 may alternatively be made by spirally melting a single thermoplastic yarn over an array of pins located on the rotatable drum roll 14. In the first rotation of the roll 14 the yarn is passed into a channel defined between two sets of pins and in the second rotation of the drum the yarn passes into the adjacent channel. This spiral wrapping of the yarn on the roll 14 allows for the production of an endless belt.

A typical belt made in accordance with the invention is described below.

A belt in the order of 9 mm wide was made incorporating 9 running direction lands each comprising Hytrel 4556 material (a trade name of Du Pont for a thermoplastic elastomer block copolymer of polybutylene terephthalate and polyethylene glycol) reinforced with a 630 denier nylon 6.6 multifilament yarns. The running direction lands were 0.5 mm wide, except for those at the belt edges which were 1.0 mm wide The thickness of the belt was 0.8 mm. The properties of the belt were as follows:—tensile strength 50 kg, extension at break 6% and air permeability 245 cubic feet per hour. This belt ran on a Protos 72 cigarette making machine for 3 hours—this machine makes approx. 7000 cigarettes per minute, equivalent to a machine speed of 420 m/minute. The life of the belts can be extended by using more abrasion resistant materials, eg. PA 6, PA 6.6 or PA 12.

It is to be understood that the above described embodiment is by way of illustration only. Many modifications and variations are possible.

We claim:

1. A tobacco conveyor belt comprising regular nonwoven mesh structure and at least one reinforcing yarn wholly in lands of the mesh and running in the intended running direction of the belt.

2. A tobacco conveyor belt as claimed in claim 1, wherein the belt comprises a tobacco suction tape.

3. A tobacco conveyor belt ad claimed in claim 1, wherein the belt comprises thermoplastic material.

4. A tobacco conveyor belt as claimed in claim 1, wherein the belt comprises at least one ultra violet-sensitive material.

5. A tobacco conveyor belt as claimed in claim 4, wherein the ultra violet-sensitive material comprises an optical brightener.

6. A tobacco conveyor belt as claimed in claim 1, wherein the belt comprises at lest one wear-resistant material selected from the following groups of compounds:—silica, alumina, ceramic, metal, ormocer or UHMW polyolefin.

7. A tobacco conveyor belt as claimed in claim 1, wherein the belt comprises a friction coefficient-lowering material.

8. A tobacco conveyor belt as claimed in claim 7, wherein the friction coefficient-lowering material comprises PTFE or an ormocer.

9. A tobacco conveyor belt as claimed in claim 1, wherein the belt is endless.

10. A tobacco conveyor belt as claimed in claim 1, wherein the belt is formed by spirally melting a yarn onto a pinned drum so as to form an endless belt.

11. A tobacco conveyor belt as claimed in claim 1, wherein said belt is formed from a structure having two ends which are fused together so as to from an endless belt.

12. A tobacco conveyor belt comprising regular non-woven mesh structure of thermoplastic material providing uniform permeability, and at least one reinforcing yarn wholly in lands of the mesh and running in the intended running direction of the belt.

13. The tobacco conveyor belt as claimed in claim 12, wherein the belt comprises at least one ultra violet-sensative material.

14. The tobacco conveyor belt as claimed in claim 12, wherein the ultra violet-sensitive material comprises an optical brightener.

15. The tobacco conveyor belt as claimed in claim 12, wherein the belt is endless.

16. A tobacco conveyor belt having a regular nonwoven mesh structure, the belt being formed by spirally melting a yarn onto a pin drum so as to form an endless belt.

17. The tobacco conveyor belt as claimed in claim 16, wherein the belt comprises thermoplastic material.

18. The tobacco conveyor belt as claimed in claim 16, wherein the belt comprises at least one ultra violet-sensitive material.

19. The tobacco conveyor belt as claimed in claim 16, wherein the ultra violet-sensitive material comprises an optical brightener.

20. The tobacco conveyor belt as claimed in claim 16, wherein the belt comprises a friction coefficient-lowering material.

* * * * *